US005506083A

United States Patent [19]

Nash et al.

[11] Patent Number: 5,506,083

[45] Date of Patent: Apr. 9, 1996

[54] CONDUCTIVE DEVELOPER COMPOSITIONS WITH WAX AND COMPATIBILIZER

[75] Inventors: Robert J. Nash, Webster; Cheryl A. Hanzlik, Fairport; Richard N. Muller, Penfield; Richard J. Hodgson, Rochester, all of N.Y.

[73] Assignee: Xerox Corporation, Stamford, Conn.

[21] Appl. No.: 379,821

[22] Filed: Jan. 27, 1995

[51] Int. Cl.[6] ..... G03G 9/087; G03G 9/097; G03G 9/113

[52] U.S. Cl. ..... 430/106; 430/108; 430/109; 430/120

[58] Field of Search ..... 430/108, 109, 430/110, 111, 120, 106, 106.6

[56] References Cited

U.S. PATENT DOCUMENTS

| | | | |
|---|---|---|---|
| 3,635,704 | 1/1972 | Palermiti et al. | 96/1 |
| 3,900,587 | 8/1975 | Lenhard et al. | 427/19 |
| 3,983,045 | 9/1976 | Jugle et al. | 252/62.1 P |
| 4,557,991 | 12/1985 | Takagiwa et al. | 430/109 |
| 4,933,251 | 6/1990 | Ichijima et al. | 430/109 |
| 4,997,739 | 3/1991 | Tomono et al. | 430/110 |
| 5,171,653 | 12/1992 | Jugle et al. | 430/108 |
| 5,212,037 | 5/1993 | Julien et al. | 430/109 |
| 5,227,460 | 7/1993 | Mahabadi et al. | 528/272 |
| 5,346,792 | 9/1994 | Kabayashi et al. | 430/109 |
| 5,364,724 | 11/1994 | Mahabadi et al. | 430/110 |
| 5,368,970 | 11/1994 | Grushkin | 430/110 |

*Primary Examiner*—Richard L. Schilling
*Attorney, Agent, or Firm*—E. D. Palazzo

[57] ABSTRACT

A developer composition comprised of a negatively charged toner composition comprised of crosslinked polyester resin particles, pigment particles, wax component particles, a compatibilizer and a surface additive mixture comprised of metal salts of fatty acids, silica particles and metal oxide particles; and carrier particles comprised of a core with a polymer coating or mixture of polymer coatings; and wherein said coating or coatings contain a conductive component.

8 Claims, No Drawings

CONDUCTIVE DEVELOPER COMPOSITIONS WITH WAX AND COMPATIBILIZER

BACKGROUND OF THE INVENTION

This invention is generally directed to toner and developer compositions, and more specifically, the present invention is directed to toner compositions, wherein more than one polymer, including at least one wax component, can be selected. In embodiments, the present invention is directed to negatively charged toner compositions comprised of polyester resins, especially certain crosslinked extruded polyesters, wax, compatibilizer, pigment, and surface additives of, for example, metal salts of fatty acids, silica particles, especially fumed silica particles available from Cabot Corporation, metal oxides like titanium dioxide, and wherein the developer is comprised of toner and carrier coated with a polymer, such as polymethylmethacrylate or mixture of polymers, such as polymethylmethacrylate (PMMA) and FPC461®, a fluorocopolymer obtained from Occidental Chemical, and wherein the carrier coating contains a conductive component like carbon black, such as VULCAN 72R® carbon black available from Cabot Corporation. In embodiments, the wax component possesses a low molecular weight, $M_w$, average, such as from about 1,000 to about 20,000, and includes polyethylene wax and polypropylene wax, and the compatibilizer is an alkylene-glycidyl methacrylate polymer as illustrated in U.S. Pat. No. 5,368,970, the disclosure of which is totally incorporated herein by reference. The toner and developer compositions of the present invention are useful in a number of known electrostatographic imaging and printing systems, such as xerographic imaging and printing systems including printing methods with lasers.

In embodiments, the conductive magnetic brush developers of the present invention can be selected for hybrid jumping development, hybrid scavengeless development, and similar processes, reference U.S. Pat. Nos. 4,868,600; 5,010,367; 5,031,570; 5,119,147; 5,144,371; 5,172,170; 5,300,992; 5,311,258; 5,212,037; 4,984,019; 5,032,872; 5,134,442; 5,153,647; 5,153,648; 5,206,693; 5,245,392 and 5,253,016, the disclosures of which are totally incorporated herein by reference. The aforementioned developers, which can contain a negatively charging toner are suitable for use with laser or LED printers, discharge area development with layered flexible photoconductive imaging members, reference U.S. Pat. No. 4,265,990, the disclosure of which is totally incorporated herein by reference, and organic photoconductive imaging members with a photogenerating layer and a charge transport layer on a drum, light lens xerography, charged area development on, for example, inorganic photoconductive members such as selenium, selenium alloys like selenium, arsenic, tellurium, hydrogenated amorphous silicon, trilevel xerography, reference U.S. Pat. Nos. 4,847,655; 4,771,314; 4,833,540; 4,868,608; 4,901,114; 5,061,969; 4,948,686, and 5,171,653, the disclosures of which are totally incorporated herein by reference, full color xerography, and the like, reference for example the Xerox Corporation 4850®. In embodiments, the developers of the present invention are preferably selected for imaging and printing systems with conductive magnetic brush development as illustrated, for example, in U.S. Pat. No. 4,678,734, the disclosure of which is totally incorporated herein by reference, and wherein there is enabled in embodiments high development levels, development to substantially complete neutralization of the photoreceptor image potential, development of low levels of image potentials, and increased background suppression. Further, the toners of the present invention are free of charge enhancing additives like cetyl pyridinium chloride, thereby minimizing or avoiding environmental problems.

With the developers of the present invention, low melting polyesters are preferably selected as the toner resin permitting, for example, lower fuser energies; the toner size is, for example, from about 7 to about 15 and preferably 9 microns in average volume diameter as determined by a Coulter Counter, and the toner possesses narrow GSD in embodiments, for example about 1.3. Additionally, the developers of the present invention in embodiments enable high levels of toner flow, for example from about 7 to about 10 grams per minute; rapid admix of, for example, about 30, and preferably 15 seconds or less, as determined by the charge spectrograph; a toner triboelectric charge of from about −12 to about −20; and high levels of developer conductivity, for example $10^{-7}$ to $10^{-8}$ $(\text{ohm-cm})^{-1}$ at a 3 percent toner concentration. Moreover, in embodiments the surface additive of a fatty acid salt like zinc stearate functions primarily as a conductivity component and the fumed silica functions primarily as a flow aid, toner blocking avoidance component, and for assistance in achieving excellent admix characteristics. The third additive of metal oxides, like titanium dioxide, in the surface mixture assists in achieving a combination of excellent toner flow, superior admix, and acceptable blocking characteristics, and moreover, the three surface mixture assists in controlling the tribocharge of the toner, especially with 0.6 weight percent of titanium dioxide P25® available from Degussa Chemicals, 0.6 weight percent of the fumed silica TS530® available from Degussa Chemicals, and zinc stearate present in an amount of 0.3 weight percent.

Toner and developers with toner additives like wax and surface additives of, for example, metal oxides and colloidal silicas are known. Toners with polyesters, including extruded polyesters, are also known, reference U.S. Pat. No. 5,227,460, the disclosure of which is totally incorporated herein by reference. In U.S. Pat. No. 4,795,689, there is disclosed an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10 for example; and U.S. Pat. No. 4,557,991 discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25.

Developer and toner compositions with certain waxes therein, which waxes can be selected as a component for the toners of the present invention, are known. For example, there are illustrated in U.K. Patent Publication 1,442,835, and a number of corresponding U.S. Patents to Konica of Japan, the disclosures of which are totally incorporated herein by reference, toner compositions containing resin particles, and polyalkylene compounds, such as polyethylene and polypropylene, of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$: from about 200 to about 6,000) to improve hot offset. In addition, many patents disclose the use of metal salts of fatty acids for toner compositions, such as U.S. Pat. No. 3,655,374, the disclosure of which is totally incorporated herein by reference. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates, such as papers, wherein there are selected toner compositions containing specific external lubricants including various waxes, see column 5, lines 32 to 45.

There are various problems observed with the inclusion of polyolefin or other waxes in toners. For example, when a polypropylene wax is included in toner to enhance the release of toner from a hot fuser roll, or to improve the lubrication of fixed toner image, it has been observed that the wax does not disperse well in the toner resin. As a result, free wax particles are released during the pulverizing step in, for example, a fluid energy mill and the pulverization rate is lower. The poor dispersion of wax in the toner resin and, therefore, the loss of wax will then impair the release function it is designed for. Scratch marks, for example, on xerographic developed toner solid areas caused by stripper fingers were observed as a result of the poor release. Furthermore, the free wax remaining in the developer will build up on the detone roll present in the xerographic apparatus causing a hardware failure.

All the problems mentioned above and others can be eliminated, or minimized with the toner compositions and processes of the present invention in embodiments thereof. The release of wax particles is, for example, a result of, for example, poor wax dispersion during the toner mechanical blending step. The wax additives should be dispersed well in the primary toner resin for them to impart their specific functions to the toner and thus the developer. For some of the additives, such as waxes like polypropylene VISCOL 550P™, that become a separate molten phase during melt mixing, the difference in viscosity between the wax and the resin can be orders of magnitude apart, thus causing difficulty in reducing the wax phase domain size. A more fundamental reason for poor wax dispersion is the inherent thermodynamic incompatibility between polymers. The Flory-Huggins interaction parameter between the resin and the wax is usually positive (repulsive) and large so that the interfacial energy remains very large in favor of phase separation into large domains to reduce interfacial area. Some degree of success has been obtained by mechanical blending of the toner formulation in certain types of mixers, such as the known Banbury mixer, where the temperature of melt can be maintained at a low level and polymer viscosities are not that far apart. However, it has been found difficult to generate an effective wax dispersion in compounding extruders where melt temperatures are typically higher. The inclusion of a compatibilizer of the present invention is designed to overcome the inherent incompatibility between different polymers, and, more specifically, between toner resin and wax, thus widening the processing temperature latitude and enabling the toner preparation in a large variety of equipment, for example an extruder. The improvement in thermodynamic compatibility will also provide for a more stable dispersion of secondary polymer phase, such as wax, in the host resin against gross phase separation over time. Also, with the present invention there are provided negatively charged toners that can be selected for discharged area development and other development processes as illustrated herein.

Illustrated in copending patent applications U.S. Ser. No. 331,444 and U.S. Ser. No. 331,441, the disclosures of which are totally incorporated herein by reference, are toners with surface additive mixtures of silica, polyvinylidene fluoride, a KYNAR®, and strontium titanate.

Illustrated in copending patent applications U.S. Ser. No. 379,822, filed concurrently herewith, is a developer composition comprised of negatively charged toner particles comprised of crosslinked polyester resin particles, pigment particles, and a surface additive mixture comprised of metal salts of fatty acids in an amount of from about 0.2 to about 0.5 weight percent, and silica particles in an amount of from about 0.2 to about 0.5 weight percent; and carrier particles comprised of a core with a coating thereover containing a conductive component; U.S. Ser. No. 379,858, filed concurrently herewith, illustrates a developer composition comprised of negatively charged toner particles comprised of crosslinked polyester resin particles, pigment particles, and a surface additive mixture comprised of metal salts of fatty acids in an amount of from about 0.2 to about 0.5 weight percent, metal oxide particles in an amount of from about 0.3 to about 1 weight percent, and silica particles in an amount of from about 0.2 to about 0.5 weight percent; and carrier particles comprised of a core with a coating thereover containing a conductive component; and U.S. Ser. No. 379,224, filed concurrently herewith, illustrates an insulating developer composition comprised of resin particles, pigment particles, wax component particles, compatibilizer, and a surface additive mixture comprised of metal salts of fatty acids, silica particles, and metal oxide particles; and carrier particles comprised of a ferrite core with a polymer coating or mixture of polymer coatings; and wherein said developer is of a conductivity of from about $10^{-14}$ to about $10^{-16}$ $(\text{ohm-cm})^{-1}$, the disclosures of which are totally incorporated herein by reference.

SUMMARY OF THE INVENTION

Examples of objects of the present invention include the following:

It is an object of the present invention to provide toner and developer compositions which possess many of the advantages illustrated herein.

Another object of the present invention resides in the provision of toner and developer compositions with stable negatively charged triboelectrical characteristics for extended time periods.

In another object of the present invention there are provided toner and developer compositions that enable improved dispersion of resin and wax components achievable in a number of devices, including an extruder.

Additionally, another object of the present invention relates to the provision of toner and developer compositions with a wax, a compatibilizer, and certain polyester resins.

In a further object of the present invention the toner mechanical blending operation can be accomplished at a melt temperature as high as 50° C. above the melting point of the wax component, thus enabling the use of a large number of apparatuses in addition to a low melt temperature mixing process using equipment such as a Banbury mixer.

Additionally, in yet another object of the present invention there are provided negatively charged toner and developer compositions with certain waxes therein or thereon that enable images of excellent quality inclusive of acceptable resolutions, and that possess other advantages as illustrated herein such as low surface energy.

Another object of the present invention resides in the provision of a negatively charged toner with a copolymer comprised of a certain compatibilizer which can possess distinct segments or blocks, each compatible with one of the toner resins or toner polymers selected, especially when two toner polymers are selected, one of which is a crosslinked polyester polymer.

Additionally, another object of the present invention relates to the provision of highly, for example $10^{-8}$ (ohm-cm)$^{-1}$ as determined in a conductivity cell, reference U.S. Pat. No. 5,196,803, the disclosure of which is totally incorporated herein by reference, conductive developer compositions especially suitable for discharged area development, and wherein in embodiments the toned developer conductivity at, for example, 3 percent toner concentration is in the range of $10^{-8}$ (ohm-cm)$^{-1}$, the developer tribo is from about −10 to about −25 and preferably from about −12 to about −20 microcoulombs per gram, the toner possesses rapid admix characteristics, for example less than 60, and preferably about 15 seconds as determined in a charge spectrograph, and there is enabled a high level of developer flow, for example 7 to 25 grams per minute in a flow tube tester.

Further, another object of the present invention relates to the provision of highly conductive toner and developer compositions especially suitable for discharged area development, and wherein in embodiments the toned developer conductivity at, for example, 3 percent toner concentration is in the range of $10^{-8}$ (ohm-cm)$^{-1}$, and the developer tribo is from about −10 to about −20 microcoulombs per gram, and wherein the toner possesses rapid admix characteristics, for example less than 60, and preferably 15 seconds as determined in a charge spectrograph, and wherein the toner selected contains a mixture of surface additives comprised of silica, metal salts of fatty acids, and metal oxides, and the carrier particles are comprised of a core with a polymer coating, or mixture of polymer coatings and which coatings contain a conductive component, preferably carbon black dispersed therein.

Moreover, in another object of the present invention there are provided toner and developer compositions with certain additives thereon and mixed with certain carriers, and which toners can be selected for xerographic imaging processes inclusive of trilevel, conductive magnetic brush, hybrid jumping development and the like, as indicated herein, reference the United States patents mentioned.

These and other objects of the present invention can be accomplished in embodiments by providing toner and developer compositions. More specifically, the present invention is directed to negatively charged toner compositions comprised of crosslinked polyester resin particles, pigment particles, waxes, a compatibilizer and surface additives, and a developer thereof with carrier particles comprised of a core with a coating or mixture of coatings thereover; and wherein a conductive component like carbon black is dispersed in the coating.

In embodiments of the present invention there are provided negatively toner compositions with a tribo charge for example of from about −10 to about −30 microcoulombs per gram, comprised of extruded low melting polyester resin particles, optional second crosslinked resin particles, carbon black pigment particles, low molecular weight waxes, such as polyethylene, and polypropylene, such as those available from Sanyo Chemicals of Japan as VISCOL 550P™, VISCOL 660P™ and the like, and as a compatibilizer the reaction product of the hydroxyl end groups or acid end groups contained on toner resin particles, especially the polyesters, with an ethylene-glycidyl methacrylate copolymer. The preferred compatibilizer is as illustrated in U.S. Pat. No. 5,368,970, the disclosure of which is totally incorporated herein by reference, which compatibilizer is the reaction product of an ethylene-glycidyl methacrylate copolymer with acid, or hydroxyl end groups, or mixtures thereof contained on the toner resin, which enables the grafted ethylene-glycidyl methacrylate copolymer to function as a compatibilizer and thus facilitate the dispersion of the wax as illustrated by the following

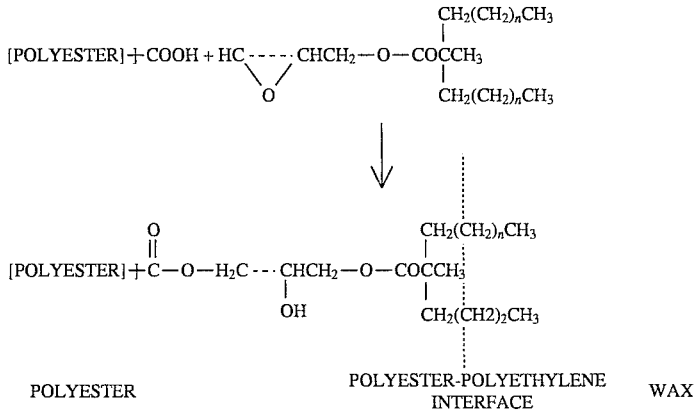

In embodiments of the present invention there are provided negatively charged toner compositions comprised of extruded polyester resin particles, preferably with a gel content of from about 25 to about 34 and preferably about 29 percent, pigment particles, especially carbon black, and surface additives comprised of a mixture of metal salts of fatty acids like zinc stearate, metal oxides, and silica particles, and wherein the aforementioned surface additives of fatty acid salts and silicas are present in an amount of from about 0. 1 to about 1 and preferably from about 0.3 to about 0.6 weight percent, and the metal oxide is present in an amount of from about 0.3 to about 1 and preferably about 0.6 weight percent, and wherein the developer is comprised of the aforementioned toners and carrier particles comprised of a core, preferably steel, solution coated with polymethylmethacrylate, and which coating contains a conductive component like carbon black, preferably VULCAN 72R® carbon black, in an amount, for example, of from about 20 to about 50 weight percent and preferably about 20 weight percent and available from Cabot Corporation. The aforementioned developers are especially useful in conductive magnetic brush xerographic imaging methods. In embodiments, the surface additives can include a metal oxide like titanium dioxide in an amount of from about 0.1 to about 1 and preferably from about 0.4 to about 0.6 weight percent.

Also, in embodiments of the present invention there are provided negatively charged toner compositions comprised of extruded polyester resin particles, preferably with a gel content of from about 25 to about 34 and preferably about 29 percent, pigment particles, especially carbon black, wax particles with a low molecular weight of from about 1,000 to about 20,000, the compatibilizer illustrated herein, and surface additives comprised of a mixture of metal salts of fatty acids like zinc stearate, metal oxides like titanium oxide, and silica particles, and wherein each of the aforementioned surface additives is present in an amount of from about 0.1 to about 1 and preferably from about 0.2 to about 0.6 weight percent, and wherein the developer is comprised of the aforementioned toners and carrier particles comprised of a core, preferably steel, solution coated with a polymer, such as polymethylmethacrylate, and which coating contains a conductive component like carbon black, preferably VULCAN 72R® carbon black available from Cabot Corporation. Preferably, in embodiments the extruded crosslinked polyester is present in an amount of 94 weight percent, the pigment carbon black is present in an amount of 6 weight percent, the zinc stearate is present in an amount of 0.3 weight percent, the fumed silica TS530® is present in an amount of 0.6 weight percent, and the titanium oxide or dioxide is present in an amount of 0.6 weight percent; the carrier is comprised of Hoeganese unoxidized core, 98 microns, solution coated with about 1 percent of an 80/20 lacquer of polymethylmethylmethacrylate/VULCAN 72R® carbon black obtained from Cabot Corporation. The toner concentration can vary and preferably is from about 2 to about 6 weight percent. Also, the carrier may contain a mixture of polymer coatings such as PMMA and FPC461® available from Occidental Chemicals, and wherein each of the polymers is present in an amount of form about 1 to about 99 and preferably from about 40 to about 60 weight percent.

Illustrative examples of suitable toner resins include polyesters, especially the polyesters of U.S. Pat. No. 5,227,460, the disclosure of which is totally incorporated herein by reference. These polyester resins can be prepared by a reactive resin such as, for example, wherein an unsaturated linear polyester resin is crosslinked in the molten state under high temperature and high shear conditions, preferably using a chemical initiator, such as, for example, organic peroxide, as a crosslinking agent in a batch or continuous melt mixing device without forming any significant amounts of residual materials. Thus, the removal of byproducts or residual unreacted materials is not needed with embodiments of the process of the invention. In preferred embodiments of this process, the base resin and initiator are preblended and fed upstream to a melt mixing device, such as an extruder at an upstream location, or the base resin and initiator are fed separately to the melt mixing device like an extruder at either upstream or downstream locations. An extruder screw configuration, length and temperature may be used which enable the initiator to be well dispersed in the polymer melt before the onset of crosslinking, and further, which provide a sufficient, but short, residence time for the crosslinking reaction to be carried out. Adequate temperature control enables the crosslinking reaction to be accomplished in a controlled and reproducible manner. Extruder screw configuration and length can also provide high shear conditions to distribute microgels, formed during the crosslinking reaction, well in the polymer melt, and to retain the microgels from inordinately increasing in size with increasing degree of crosslinking. An optional devolatilization zone may be used to remove any volatiles, if needed. The polymer melt may then be pumped through a die to a pelletizer. One suitable type of extruder is the fully intermeshing corotating twin screw extruder such as, for example, the ZSK-30 twin screw extruder, available from Werner & Pfleiderer Corporation, Ramsey, N.J., U.S.A., which has a screw diameter of 30.7 millimeters and a length-to-diameter (L/D) ratio of 37.2. The extruder can melt the base resin, mix the initiator into the base resin melt, provide high temperature and adequate residence time for the crosslinking reaction to be carried out, control the reaction temperature via appropriate temperature control along the extruder channel, optionally devolatilize the melt to remove any effluent volatiles if needed, and pump the crosslinked polymer melt through a die, such as, for example, a strand die, to a pelletizer. For chemical reactions in highly viscous materials, reactive extrusion is particularly efficient, and is advantageous because it requires no solvents, and thus is easily environmentally controlled. It is also advantageous because it permits a high degree of initial mixing of base resin and initiator to take place, and provides an environment wherein a controlled high temperature (adjustable along the length of the extruder) is available so that a very quick reaction can occur. It also enables a reaction to take place continuously, and thus the reaction is not limited by the disadvantages of a batch process, wherein the reaction must be repeatedly stopped so that the reaction products may be removed and the apparatus cleaned and prepared for another similar reaction. As soon as the desired amount of crosslinking is achieved, the reaction products can be quickly removed from the reaction chamber.

The crosslinked resin produced comprises crosslinked gel particles and a noncrosslinked or linear portion but substantially no sol. The gel content of the crosslinked resin ranges from about 0.001 to about 50 percent by weight, and preferably from about 0.1 to about 40 or 10 to 19 percent by weight, wherein the gel content is determined as follows:

$$\text{Gel Content} = \frac{\text{Total Sample Weight} - \text{Weight of Soluble Polymer}}{\text{Total Sample Weight}} \times 100\%$$

There is substantially no crosslinked polymer which is not gel, that is low crosslink density polymer or sol, as would be obtained in conventional crosslinking processes such as, for example, polycondensation, bulk, solution, suspension, emulsion and suspension polymerization processes.

The crosslinked portions of the crosslinked polyester resin are comprised of very high molecular weight microgel particles with high density crosslinking (as measured by gel content), and which are not soluble in substantially any solvents such as, for example, tetrahydrofuran, toluene and the like. The microgel particles are highly crosslinked polymers with a short crosslink distance of zero or a maximum of one atom such as, for example, oxygen.

The linear portions of the crosslinked resin have substantially the same number average molecular weight ($M_n$), weight-average molecular weight ($M_w$), molecular weight distribution ($M_w/M_n$), onset glass transition temperature ($T_g$) and melt viscosity as the base resin. Thus, embodiments of the entire crosslinked resin have an onset glass transition temperature of from about 50° C. to about 70° C., and preferably from about 51° C. to about 60° C., and a melt viscosity of from about 5,000 to about 200,000 poise, and preferably from about 20,000 to about 100,000 poise at 100° C., and from about 10 to about 20,000 poise at 160° C.

Numerous well known suitable pigments can be selected as the colorant for the toner particles including, for example, carbon black like REGAL 330®, BLACK PEARLS®, and the like available from Cabot Corporation. The pigment, which is preferably carbon black, should be present in a sufficient amount to render the toner composition colored thereby permitting the formation of a clearly visible image. Generally, the pigment particles are present in amounts of from about 2 percent by weight to about 20 percent by weight, and preferably from about 5 to about 10 weight percent, based on the total weight of the toner composition, however, lesser or greater amounts of pigment particles may be selected in embodiments.

Examples of low molecular weight, for example from about 1,000 to about 20,000, and preferably from about 1,000 to about 7,000, waxes include those as illustrated in the British 1,442,835 patent publication, the disclosure of which is totally incorporated herein by reference, such as polyethylene, polypropylene, and the like, especially VISCOL 550P™ and VISCOL 660P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax, which can remain with the toner, will build up on the internal parts of the xerographic cleaning device causing a machine failure.

The compatibilizer is as illustrated herein and, more specifically, in embodiments includes copolymers that can be reacted with the toner resin like polyesters, such as copolymers of ethylene-glycidyl methacrylate ester, LOTADER AX8840™, available from ELF ATOCHEM, NA, Inc., containing 8 weight percent of glycidyl ester which was particularly effective as a wax dispersant when melt mixed with a polyester comprised of the reaction products of propoxylated bisphenol A and fumaric acid which had been crosslinked with benzoyl peroxide thereby forming 30 weight percent of gel. The reaction product of polyester and 0.5 to 5.0 weight percent and preferably, 1.0 to 3.0 weight percent of LOTADER AX8840™ can be accomplished in a Werner Pfleiderer extruder in the presence of the aforementioned waxes, pigment, and optional charge enhancing additive. Extrusion set temperatures were adjusted so that the exiting extrudate had a temperature of from 115° C. to 160° C. When VISCOL 660P™ was used, the preferred temperature was from about 138° C. to about 150° C. When crystalline polyethylene, such as POLYWAX 1000™ available from PETROLITE Corporation, was used, the extruder set temperatures were adjusted to provide an extrudate exiting the extruder with a temperature of 100° C. to 120° C. In another embodiment of the present invention, LOTADER AX8840™ and the reaction product of propoxylated bisphenol A and fumaric acid were extruded in the presence of 0.3 to 1.5 weight percent of benzoyl peroxide at a temperature of 140° to 180° C. The extrudate was then re-extruded with wax, pigment, after which it was converted to toner by attrition. Alternatively, LOTADER AX8840™ and wax were melt mixed as a master batch with ratios of 1:1 to 10:1, then re-extruded with polyester, pigment, and additional wax. In this embodiment, constituent ratios can be adjusted in a manner that the LOTADER AX8840™ is present in an amount of from 0.2 to 10 percent, and preferably from 1 to 4 weight percent, and the wax is present in an amount of from 2 to 10 weight percent, and preferably from 3 to 7 weight percent. After melt mixing by extrusion, micronization and classification to a volume average size of 7 to 10 micrometers, the toner of the present invention was examined by optical microscopy at 400× magnification with crossed polarizers and found to contain no free wax as would have been evident by the appearance of birefringant particles.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected to be of a positive polarity thereby enabling the toner particles, which are negatively charged, to adhere to and surround the carrier particles. Illustrative examples of known carrier particles that may be selected include grit steel available from Hoeganese of Canada, nickel, iron, ferrites like copper zinc ferrites, available from Steward Chemicals, and the like. The carrier particles may include thereon a known coating, or mixtures thereof, like polymethylmethacrylate, and the like. Examples of specific coatings that may be selected include a mixture of PMMA and vinyl chloride/trifluorochloroethylene copolymer available as FPC461®, which coating contains therein conductive particles, such as a conductive carbon black. The carrier coating, or coatings include therein conductive components like carbon black in an amount, for example, of from about 10 to about 40 and preferably about 20 weight percent. One carrier coating is comprised of 1 weight percent of polymethylmethacrylate with carbon black dispersed therein, and which carriers are prepared by solution coating of an 80/20 lacquer of the PMMA/carbon black, and wherein preferably VULCAN 72R® carbon black was selected.

Also, while the diameter of the carrier particles can vary, generally they are of a diameter of from about 50 microns to about 1,000 microns, and preferably from about 50 to about 200 microns, thus allowing these particles to possess sufficient density and inertia to avoid adherence to the electrostatic images during the development process. The carrier particles can be mixed with the toner particles in various suitable combinations, such as from about 1 to about 3 parts per toner to about 50 parts to about 100 parts by weight of carrier. Toner concentrations of from about 2 to about 5 and preferably about 3 are preferred in embodiments.

The toner compositions of the present invention can be prepared by a number of known methods, including mechanical blending and melt blending the toner resin particles, pigment particles or colorants, compatibilizer, wax, optional known toner additives, followed by mechanical attrition including classification. The toner particles are usually pulverized and classified, thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. Subsequently, the toner surface additive mixture is included on the toner by, for example, the mixing of the toner and surface additives.

The toner surface additives are present in effective amounts of, for example, from about 0.1 to about 5 weight percent. Examples of additives include mixtures of metal salts of fatty acids, like zinc stearate, magnesium stearate, fumed silica particles, and metal oxides like titanium dioxide. Especially preferred in embodiments is 0.3 weight percent of zinc stearate, 0.6 weight percent of AEROSIL TS530® obtained from Cabot Corporation, and 0.6 weight percent of titanium dioxide P25® $TiO_2$ obtained from Degussa Chemicals. In embodiments, the metal salt, such as zinc stearate, is present in an amount of from about 0.2 to about 1 and preferably 0.3 weight percent; the silica is present in an amount of from about 0.2 to about 0.8 and preferably 0.6 weight percent; and the metal oxide like titanium oxide ($TiO_2$) P25® is present in an amount of from about 0.4 to about 1.5 and preferably 0.6 weight percent.

The toner and developer compositions of the present invention may be selected for use in developing images in electrostatographic imaging systems containing therein, for example, conventional photoreceptors, such as selenium and selenium alloys. Also useful, especially wherein there is selected negatively charged toner compositions, are layered photoresponsive imaging members comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, and the like.

The following Examples are provided, wherein parts and percentages are by weight unless otherwise indicated. A Comparative Example is also provided.

EXAMPLE I

A crosslinked unsaturated polyester resin can be prepared by the reactive extrusion process by melt mixing 99.3 parts of a linear unsaturated polyester with the following structure

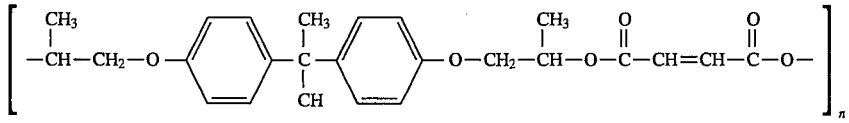

wherein n is the number of repeating units and having $M_n$ of about 4,000, $M_w$ of about 10,300, $M_w/M_n$ of about 2.58 as measured by GPC onset $T_g$ of about 55° C. as measured by DSC and melt viscosity of about 29,000 poise at 100° C. and about 750 poise at 130° C. as measured at 10 radians per second, and 0.7 parts benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder with a screw diameter of 30.7 mm and a length-to-diameter (L/D) ratio of 37.2 at 10 pounds per hour using a loss-in-weight feeder. The crosslinking is carried out in the extruder using the following process conditions: barrel temperature profile of 70°/140°/140°/140°/140°/140°/140° C., die head temperature of 140° C., screw speed of 100 revolutions per minute and average residence time of about three minutes. The extrudate melt, upon exiting from the strand die, is cooled in a water bath and pelletized. The product, which is crosslinked polyester, has an onset $T_g$ of about 54° C. as measured by DSC melt viscosity of about 40,000 poise at 100° C. and about 150 poise at 160° C. as measured at 10 radians per second, a gel content of about 0.7 weight percent, and a mean microgel particle size of about 0.1 micron as determined by transmission electron microscopy.

For characterization tests, the linear and crosslinked portions of the product are separated by dissolving the product in tetrahydrofuran and filtering off the microgel. The dissolved part is reclaimed by evaporating the tetrahydrofuran. This linear part of the resin, when characterized by GPC is found to have $M_n$ of about 3,900, $M_w$ of about 10,100, $M_w/M_n$ of about 2.59, and onset $T_g$ of 55° C. which is substantially the same as the original noncrosslinked resin, which indicates that it contains no sol.

EXAMPLE II

A crosslinked unsaturated polyester resin is prepared by the reactive extrusion process by melt mixing 98.6 parts of a linear unsaturated polyester with the structure and properties described in Example I, and 1.4 parts benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder at 10 pounds per hour using a loss-in-weight feeder. The crosslinking is carried out in the extruder using the following process conditions: barrel temperature profile of 70°/160°/160°/

160°/160°/160°/160° C., die head temperature of 160° C., screw rotational speed of 100 revolutions per minute and average residence time of about three minutes. The extrudate melt, upon exiting from the strand die, is cooled in a water bath and pelletized. The product, which is crosslinked polyester, has an onset $T_g$ of about 54° C. as measured by DSC, melt viscosity of about 65,000 poise at 100° C. and about 12,000 poise at 160° C. as measured at 10 radians per second, a gel content of about 50 weight percent and a mean microgel particle size of about 0.1 micron as determined by transmission electron microscopy.

For characterization tests, the linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 3,900, $M_w$ of about 10,100, $M_w/M_n$ of about 2.59, and onset $T_g$ of 55° C. which is substantially the same as the original noncrosslinked resin, which indicates that it contains no sol.

EXAMPLE III

A toner was prepared by admixing in an extruder at about 125° C. 87 weight percent of the crosslinked polyester of Example I and with a gel content of 29, 4 weight percent of 660P® polypropylene wax obtained from Sanyo Chemicals of Japan, 4 weight percent of the compatibilizer AX8840®, and 5 weight percent of REGAL 330® carbon black. Subsequently, the toner was classified to enable toner particles with an average particle volume diameter of 9 microns as determined by a Coulter Counter. Thereafter, there was added to the toner by mixing therewith in a jar mill with ⅛ inch diameter steel beads a mixture of surface additives of 0.3 weight percent of zinc stearate, 0.6 weight percent of fumed colloidal silica TS530® obtained from Cabot Corporation and 0.6 weight percent of titanium oxide P25® $TiO_2$ obtained from Degussa Chemicals.

About three parts of the above prepared toner and 100 parts of carrier were admixed to provide a developer. The carrier particles were comprised of a 90 micron Hoeganese unoxidized steel grit core solution coated with 1.06 weight percent of an 80/20 (80 weight percent, and 20 weight percent) lacquer of polymethylmethacrylate/VULCAN 72R® carbon black.

The toner triboelectric charge was a negative −17 microcoulombs per gram at 2.78 toner concentration as determined by the known Faraday Cage method. The developer breakdown potential in volts was 40 and for the detoned carrier the breakdown voltage was 24; the developer conductivity was $5.5\times10^{-7}$ (ohm-cm)$^{-1}$ and $3.3\times10^{-5}$ (ohm-cm)$^{-1}$ for detoned carrier as determined by a conductivity cell, reference U.S. Pat. No. 5,196,803, the disclosure of which is totally incorporated herein by reference. The developer conductivity sensitivity parameter alpha, that is alpha= [$\log_e$(carrier conductivity/developer conductivity)]/[toner concentration], was an excellent 1.47. It is preferred that alpha be small, for example 5 or less, and more preferably 1 to about 3. The toner admix was 15 seconds as determined in the known charge spectrograph.

The same comparative developer without the three above surface additives had a tribocharge of −16.5 at 2.76 toner concentration, a developer breakdown potential of 43 volts, and 23 volts for detoned carrier, a developer conductivity of $5.3\times10^{-8}$ at a 2.76 toner concentration, and a detoned carrier conductivity of $2.3\times10^{-6}$ (ohm-cm)$^{-1}$. Alpha was 1.37 and the admix was still incomplete after 60 seconds as determined by a charge spectrograph.

EXAMPLE IV

A developer was prepared by repeating the process of Example III with the three surface additives and with carrier particles, 90 micron Hoeganese steel grit with the following solution coated components: (1) PMMA/FPC461®/VULCAN carbon black 72R®, 52/28/20 weight percent; (2) PMMA/FPC461®/VULCAN carbon black 72R®, 40/40/20 weight percent; (3) PMMA/FPC461®/VULCAN carbon black 72R®, 28/52/20 weight percent; and (4) 98 micron Hoeganese steel grit with a coating of PMMA/FPC461®/VULCAN carbon black 72R®, 80/0/20 weight percent. The toner concentration was about three percent in each instance for the above developers. PMMA is polymethylmethacrylate, and FPC461® is vinyl chloride/trifluorochloroethylene.

For (1) the toner triboelectric charge was a negative −15.5 microcoulombs per gram at 2.89 toner concentration as determined by the known Faraday Cage method. The developer breakdown potential in volts was 57 and for detoned carrier the breakdown voltage was 21; the developer conductivity was $2.97\times10^{-8}$(ohm-cm)$^{-1}$ and $8.9\times10^{-6}$ (ohm-cm)$^{-1}$ for detoned carrier. The developer Alpha was 1.97. The toner admix was 15 seconds as determined in the known charge spectrograph. Alpha and conductivity were determined in all instances as indicated in Example III.

For (2) the toner triboelectric charge was a negative −12.1 microcoulombs per gram at 2.82 toner concentration as determined by the known Faraday Cage method. The developer breakdown potential in volts was 55 and for detoned carrier the breakdown voltage was 21; the developer conductivity was $3.13\times10^{-8}$(ohm-cm)$^{-1}$ and $5.08\times10^{-6}$ (ohm-cm)$^{-1}$ for detoned carrier. The developer Alpha was 1.81. The toner admix was 15 seconds as determined in the known charge spectrograph.

For (3) the toner triboelectric charge was a negative −11.6 microcoulombs per gram at 2.81 toner concentration as determined by the known Faraday Cage method. The developer breakdown potential in volts was 39 and for detoned carrier the breakdown voltage was 18; the developer conductivity was $4.4\times10^{-7}$(ohm-cm)$^{-1}$ and $2.97\times10^{-5}$(ohm-cm)$^{-1}$ for detoned carrier. The developer Alpha was 1.50. The toner admix was 15 seconds as determined in the known charge spectrograph.

For (4) the toner triboelectric charge was a negative −20.1 microcoulombs per gram at 2.90 toner concentration as determined by the known Faraday Cage method. The developer breakdown potential in volts was 70 and for detoned carrier the breakdown voltage was 25; the developer conductivity was $4.5\times10^{-9}$(ohm-cm)$^{-1}$ and $5.76\times10^{-6}$ (ohm-cm)$^{-1}$ for detoned carrier. The developer Alpha was 2.47. The toner admix was 15 seconds as determined in the known charge spectrograph.

The developers of Example IV demonstrate that the developer triboelectric charge can be effectively changed from about −12 to about −20 microcoulombs per gram at about 3 weight percent toner concentration without, for example, any major changes in other developer properties such as conductivity and admix, and wherein the change in triboelectric charge level being adjusted primarily by the PMMA/FPC461®coating ratio.

COMPARATIVE EXAMPLE V

As a Comparative Example, toner and developer were prepared by repeating the process of Example III with the exception that the carrier coating was comprised of 80 weight percent of polymethylmethacrylate and 20 weight percent of VULCAN 72R® carbon black, which carbon black was dispersed in the aforementioned polymer carrier coating, the carrier was 98 microns in diameter, and the toner contained no surface additives of zinc stearate, TS530®, and P25®. The toner triboelectric charge was a negative −16.5 microcoulombs per gram at 2.76 toner concentration as determined by the known Faraday Cage method. The developer breakdown potential in volts was 43 for toned carrier and 23 for untoned or detoned carrier, that is where the carrier contains no toner, the developer conductivity was $5.3\times10^{-8}$ (ohm-cm)$^{-1}$ for toned carrier and $2.3\times10^{-6}$ for detoned carrier and the alpha was 1.37. The toner admix was still incomplete after 60 seconds of mixing.

This Comparative Example demonstrates, for example, that the external additives provide for rapid admix, and which rapid admix is necessary for minimization of background and dirt generation during imaging in, for example, xerographic imaging and printing systems.

Other modifications of the present invention may occur to those skilled in the art subsequent to a review of the present application. The aforementioned modifications, including equivalents thereof, are intended to be included within the scope of the present invention.

What is claimed is:

1. A conductive developer composition consisting of a negatively charged toner composition comprised of crosslinked polyester resin particles, pigment particles, low molecular weight wax component particles, an alkylene-glycidyl methacrylate polymer compatibilizer, and a surface additive mixture comprised of from about 0.1 to about 0.8 weight percent in each instance of metal salts of fatty acids, silica particles and metal oxide particles; and carrier particles comprised of a core with a polymer coating or mixture of polymer coatings, and wherein said coating or coatings contain a conductive component; and wherein the conductivity of said developer is about $10^{-8}$ (ohm-cm)$^{-1}$, and wherein said conductive component is present in the polymer coating or mixture of polymer coatings in an amount of from about 10 to about 40 weight percent, and wherein said molecular weight for said wax component is from about 1,000 to about 20,000 weight average molecular weight.

2. A developer composition in accordance with claim 1 wherein the compatibilizer is comprised of the reaction product of an ethylene-glycidyl methacrylate copolymer with acid, or hydroxyl end groups, or mixtures of said groups and said toner resin particles.

3. A developer composition in accordance with claim 1 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

4. A developer composition in accordance with claim 1 wherein the pigment particles are carbon black.

5. A developer composition in accordance with claim 1 wherein the wax is present in an amount of from about 1 to about 10 weight percent.

6. A developer composition in accordance with claim 1 wherein the carrier coating weight is about 1 percent.

7. A method for obtaining images which comprises generating an electrostatic latent image on a layered photoconductive imaging member, subsequently affecting development of this image with the toner composition of claim 1, thereafter transferring the image to a permanent substrate, and permanently affixing the image thereto.

8. A developer composition consisting of a negatively charged toner composition comprised of crosslinked polyester resin particles, pigment particles, wax component particles, a compatibilizer and a surface additive mixture comprised of metal salts of fatty acids, silica particles and metal oxide particles; and carrier particles comprised of a core with a polymer coating or mixture of polymer coatings; and wherein said coating or coatings contain a conductive component; and wherein said molecular weight for said wax component is from about 1,000 to about 20,000 weight average molecular weight, wherein said developer is conductive and wherein said developer possesses a conductivity of from about $10^{-8}$ (ohm-cm)$^{-1}$, and wherein said polymer coating or mixture of polymer coating includes therein said conductive component in an amount of from about 10 to about 40 weight percent, and said metal salts of fatty acids, silica particles, and metal oxide particles are each present in amount of from about 0.1 to about 5 weight percent; and further wherein said metal salt is zinc stearate present in an amount of 0.3 weight percent, said silica particles are present in an amount of 0.6 weight percent, and said metal oxide particles are titanium dioxide present in an amount of 0.6 weight percent.

* * * * *